US008088461B2

(12) United States Patent
Fujihana et al.

(10) Patent No.: US 8,088,461 B2
(45) Date of Patent: Jan. 3, 2012

(54) GLOVE

(75) Inventors: Terukazu Fujihana, Himeji (JP); Yoshiteru Fukumoto, Himeji (JP); Yasushi Okada, Himeji (JP)

(73) Assignee: Showa Glove Co., Himeji-shi (JP)

( * ) Notice: Subject to any disclaimer, the term of this patent is extended or adjusted under 35 U.S.C. 154(b) by 818 days.

(21) Appl. No.: 12/187,480

(22) Filed: Aug. 7, 2008

(65) Prior Publication Data

US 2009/0038051 A1 Feb. 12, 2009

(30) Foreign Application Priority Data

Aug. 7, 2007 (JP) ..... 2007-205760
Jul. 16, 2008 (JP) ..... 2008-185216

(51) Int. Cl.
*B29D 22/00* (2006.01)
*B29D 23/00* (2006.01)
*B32B 1/08* (2006.01)
*B65D 39/00* (2006.01)

(52) U.S. Cl. ..... 428/36.5; 428/35.2; 428/35.7; 428/36.8; 2/161.6; 2/159; 2/168; 2/161.8; 2/161.7; 2/167; 2/161.1

(58) Field of Classification Search ..... 2/161.6, 2/159, 168, 161.8, 161.7, 167, 161.1; 428/35.2, 428/35.7, 36.5, 36.8
See application file for complete search history.

(56) References Cited

U.S. PATENT DOCUMENTS

2006/0048268 A1* 3/2006 Loos ..... 2/161.6

FOREIGN PATENT DOCUMENTS

| | | |
|---|---|---|
| JP | 4-333604 | 11/1992 |
| JP | 6-68660 | 9/1994 |
| JP | 11-279818 | 10/1999 |
| JP | 2001-192915 A1 | 7/2001 |
| JP | 2001-192916 A1 | 7/2001 |

* cited by examiner

*Primary Examiner* — Michael C Miggins
(74) *Attorney, Agent, or Firm* — Kratz, Quintos & Hanson, LLP

(57) ABSTRACT

The present invention aims to provide anti-slip gloves which exhibit excellent anti-slipping effects under slippery conditions such as wet conditions caused by moisture, detergents or oils, provide an excellent durability in repeated use, keep down production costs, and can be used in various applications. The glove of the invention has an anti-slip layer comprising pulverized fragments of a foamed melamine resin, or a mixture of pulverized fragments of a foamed melamine resin and NBR particles contained in a resin or rubber formed on the surface thereof. The pulverized fragments of the foamed melamine resin are particulate subfragments obtained by pulverizing the foamed melamine resin. The foamed melamine resin has a three-dimensional lattice structure, and the pulverized fragments of the foamed melamine resin obtained by pulverizing the foam have cut limbs extending three dimensionally, which are obtained by cutting the lattice parts.

18 Claims, 3 Drawing Sheets

(a)

(b)

(a)

(b)

GLOVE

BACKGROUND OF THE INVENTION

1. Field of the Invention

The present invention relates to a glove having an anti-slip layer at least on a part of a surface the palm area, and particularly to a glove which has excellent anti-slipping effect toward moisture, detergent wetness or oil wetness, and can be applied in work or sports.

2. Related Background Art

As for gloves having an anti-slip layer, those in which a polyurethane or vinyl chloride resin particles coats the surface thereof have hitherto been proposed (see, for example, Japanese Unexamined Patent Publication No. 4-333604). Those gloves, however, do not have sufficient effectiveness, in particular, on wetness caused by oil.

Gloves having a surface layer comprising a rubber particle as an anti-slip layer are also proposed; for example, a glove in which a rubber particle coats a surface thereof using a rubbery polymer as a binder, the rubber particle having a particle size of 10 to 100-mesh, a content of matter insoluble in methyl ethyl ketone being 30% by weight or more, a difference in the solubility parameter between a polymer forming the rubber particles and a rubbery polymer forming the glove being 1.0 or less; a glove in which a coating film formed from a rubber latex comprising styrene-butadiene rubber particles or a resin emulsion is formed on a surface of a glove made of a knit or woven cloth, and the like (see, for example, Japanese Unexamined Patent Publications No. 11-279818, No. 2001-192915, and No. 2001-192916). Although the gloves having the surface layer have improved durability in repeated use, toward moisture, detergent wetness or oil wetness, their anti-slipping effects are not sufficient.

Gloves in which a cloth having pile made of synthetic fiber filaments on a ground weave is attached to a palm part of a resin glove have been also proposed (see, for example, Japanese Utility Model Publication No. 6-68660). These gloves can be used when washing dishes, cleaning toilets or bathing, since engrained soil is easily removed when the gloves are used as a cleaner because of the protrusion of the pile made of the synthetic fiber filaments from the palm part of the resin gloves. However, these gloves require an increased production cost, and their use is limited; for example, in a case in which food is handled, they cannot be used from a viewpoint of sanitation.

SUMMARY OF THE INVENTION

In view of the circumstances outlined above, the aim to be attained by the present invention is to provide gloves having an anti-slip layer whose anti-slipping effects are excellent under slippery conditions, in particular, wet conditions caused by moisture, detergents or oils, whose anti-slip layer has excellent durability in repeated use, whose production cost is kept low, and which can be used in various applications.

That is, the present invention provides a glove containing: a glove made of a resin or rubber, or a base cloth for a glove coated with a resin or rubber; and an anti-slip layer formed on at least a part of surface of the glove as mentioned above, the anti-slip layer containing, in a resin or rubber, pulverized fragments of a foamed melamine resin or a mixture of pulverized fragments of a foamed melamine resin and NBR (nitrile-butadiene rubber) particles.

It is preferable that the pulverized fragments of the foamed melamine resin herein are those produced by pulverizing a foamed melamine resin having a three-dimensional lattice structure, and have cut limbs extending three dimensionally which are produced by cutting the lattice parts.

The height of protrusions of the pulverized fragments of the foamed melamine resin which protrude from the surface of the anti-slip layer is preferably from 3 to 400 μm, more preferably from 3 to 200 μm, further more preferably from 15 to 200 μm.

The maximum linear length of the pulverized fragments of the foamed melamine resin is from 1 to 700 μm, more preferably from 3 to 500 μm, further more preferably from 3 to 400 μm.

It is preferable that the anti-slip layer contains 3 to 70 parts by weight of the pulverized fragments of the foamed melamine resin relative to 100 parts by weight of the resin or rubber component. The addition of the pulverized fragments of the foamed melamine resin can give anti-slipping effects toward moisture, detergents or oils, and particularly the anti-slipping effect toward oils can be exhibited when 3 parts by weight or more of the pulverized fragments are added. However, the addition of more than 70 parts by weight tends to cause the agglomeration of the pulverized fragments of the foamed melamine resin, thus resulting in, disadvantageously, ununiform adhesion in the glove.

When the mixture of the pulverized fragments of the foamed melamine resin and the NBR particles is contained in the resin or rubber, it is preferable that the height of protrusions of the NBR particles which protrude from the surface of the anti-slip layer is from 30 to 1500 μm. Also, it is preferable that the average height of the protrusions of the NBR particles which protrude from the surface of the anti-slip layer is higher than the average height of the protrusions of the pulverized fragments of the foamed melamine resin which protrude from the surface of the anti-slip layer.

It is preferable that the anti-slip layer is formed by coating a polyurethane resin containing the pulverized fragments of the foamed melamine resin, because the anti-slipping effect against moisture, detergents or oils can be made more excellent. Further, it is preferable that the anti-slip layer is formed by coating a polyurethane resin containing the mixture of the pulverized fragments of the foamed melamine resin and the NBR particles, the excellent anti-slipping effect can be obtained also under non-wet conditions.

Also, it is preferable that the anti-slip layer has a thickness of 5 to 30 μm. When the thickness is less than 5 μm, the production becomes difficult and the pulverized fragments are easily removed from the glove. When the thickness is more than 30 μm, the thickness of the glove becomes thick, which makes it stiff, and the workability tends to lower.

The term "height of the protrusion" of the pulverized fragments of the foamed melamine resin or the NBR particles refers to a vertical distance from the almost-even surface of the outer side of the anti-slip layer to the pointed tip of the protrusion, which protrudes convexly and is formed by the pulverized fragment of the foamed melamine resin or the NBR particle. The protrusions include, in addition to those in which the whole pulverized fragments of the foamed melamine resin or the whole NBR particles extend outward from the surface and are completely exposed, those in which the pointed tips are exposed but the proximal sides are coated with the resin or rubber. The height therefore refers to a measured value of the vertical distance between the almost even surface and the pointed tip of the protrusion.

According to the present invention having the structure outlined above, since the anti-slip layer containing the pulverized fragments of the foamed melamine resin contained in the resin or rubber is formed on at lease the surface layer part, the pulverized fragments of the foamed melamine resin can give the excellent anti-slipping effects toward moisture, detergent wetness, or oil wetness, and gloves can be easily produced at a low costs. Also, the fur does not fall like in a case of using the pile, and thus the obtained gloves can be used in the food application and the like.

Also, since the foamed melamine resin is one having a three-dimensional lattice structure, and the pulverized fragments of the foamed melamine resin, which are obtained by pulverizing the foam, have cut limbs extending three dimensionally, which are obtained by cutting the lattice parts, the anti-slipping effect is further improved, and the sufficient anti-slipping effect can be exhibited under slippery conditions such as oil-wet conditions.

Further, when the NBR particles are contained together with the pulverized fragments of the foamed melamine resin, the excellent anti-slipping effects can be exhibited toward a dry glass surface, in addition to the moisture wetness, detergent wetness, and oil wetness. In particular, when the average height of the protrusions of the NBR particles which protrude from the surface of the anti-slip layer is higher than that of the protrusions of the pulverized fragments of the foamed melamine resin which protrude from the surface of the anti-slip layer, more reliable anti-slipping effect is exhibited toward the dry glass surface.

DETAILED DESCRIPTION OF THE INVENTION

The embodiments of the present invention will be described in detail below.

Figure 1:
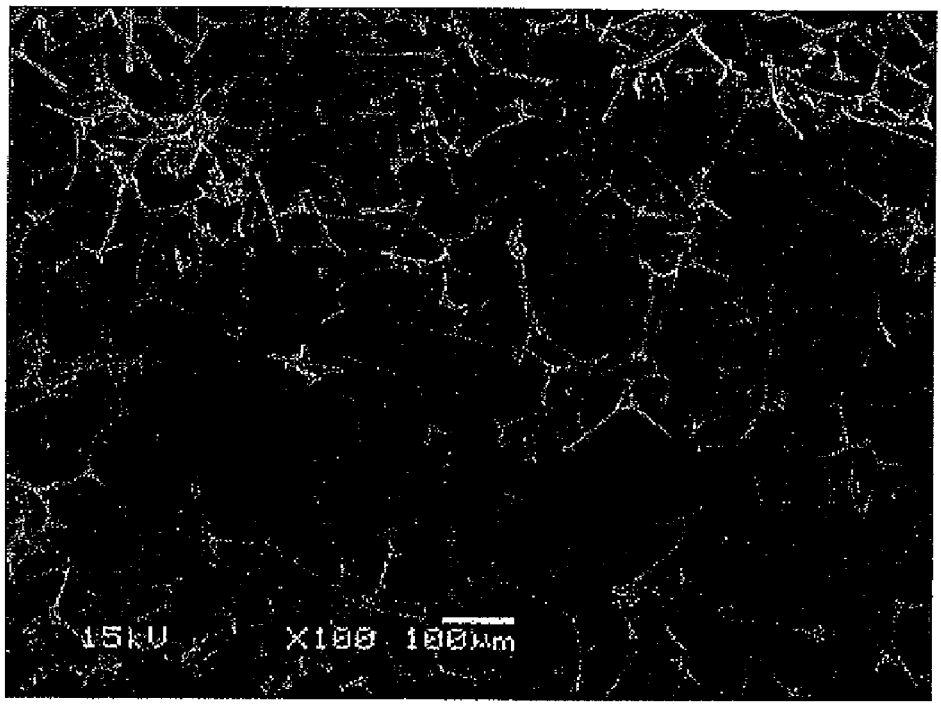
FIG. 1 is an electron microscope photograph showing pulverized fragments of a foamed melamine resin.
Figure 2:
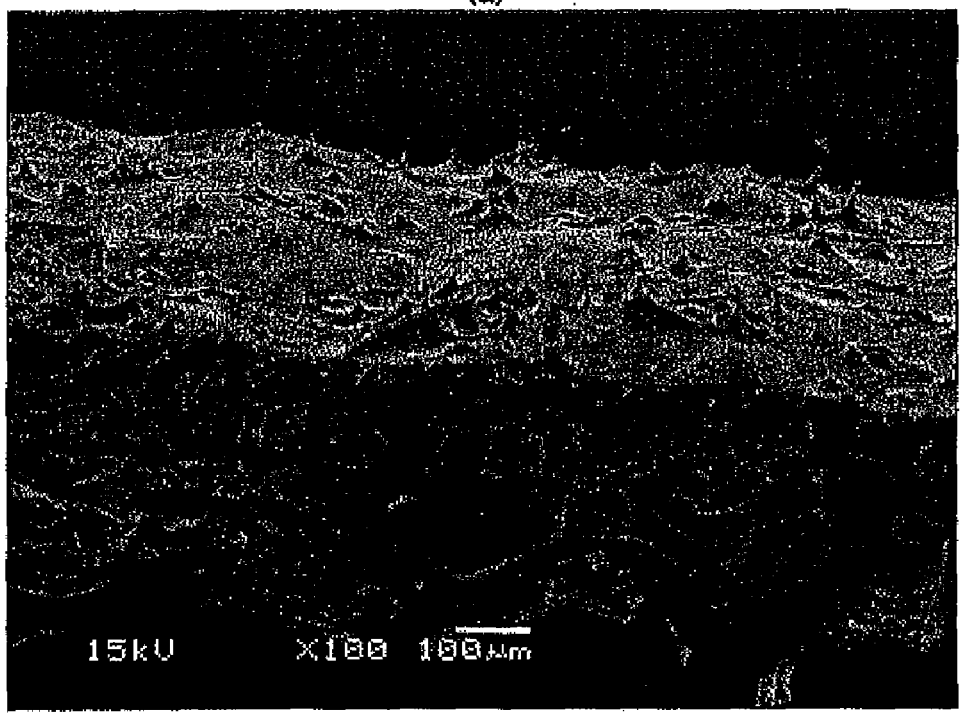
FIG. 2(*a*) is an electron microscope photograph showing the surface of an anti-slip layer in Example 1, and FIG. 2(*b*) is an electron microscope photograph with an increased magnification showing the same surface as above.
Figure 2:
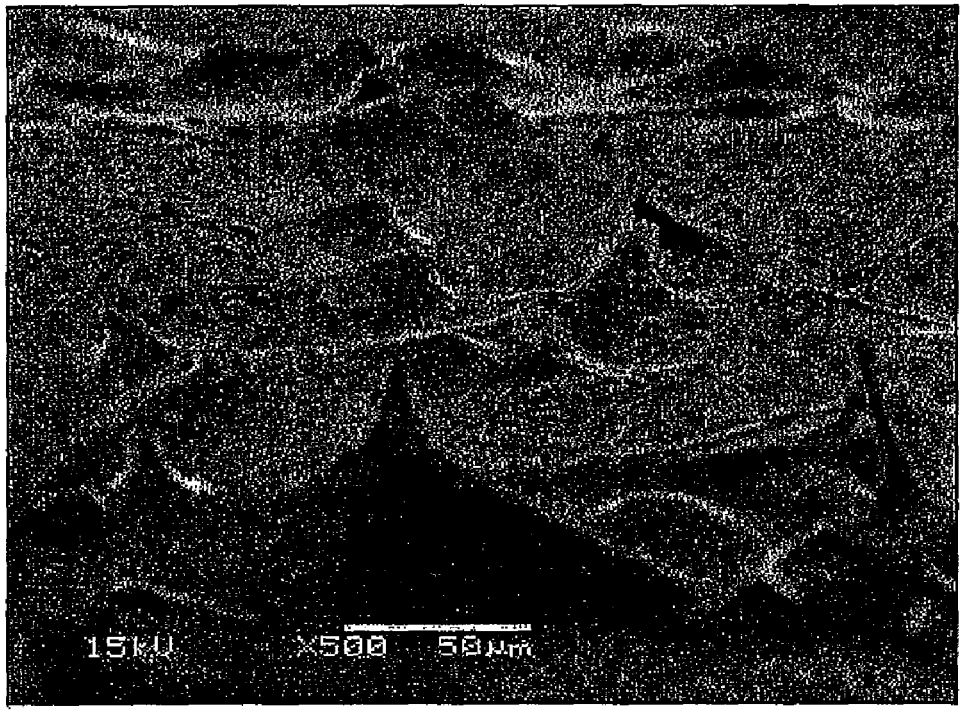
Figure 3:
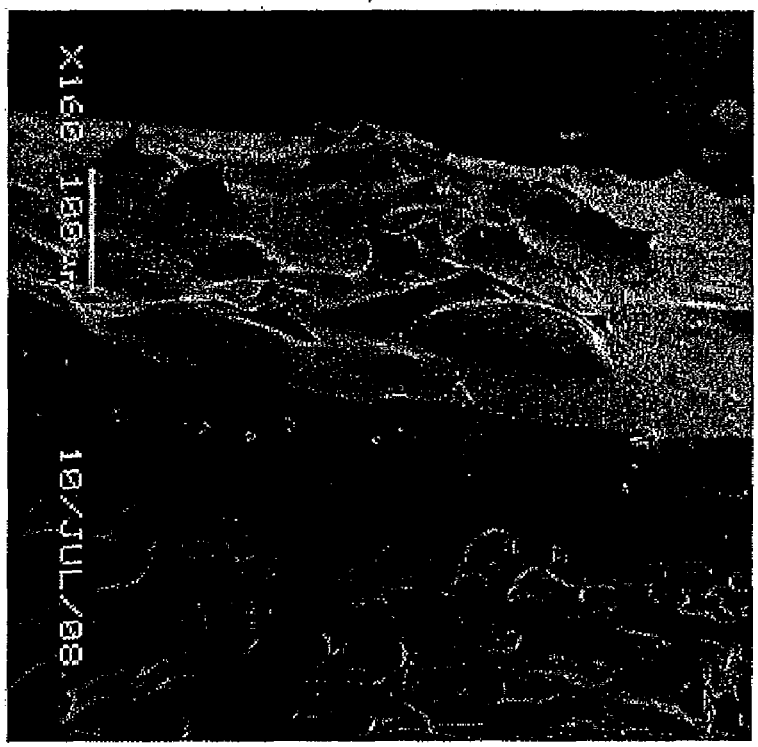
FIG. 3(*a*) is an electron microscope photograph showing the surface of an anti-slip layer in Example 8, and FIG. 3(*b*) is an electron microscope photograph showing the same surface as above which was taken from an angle.
Figure 3:
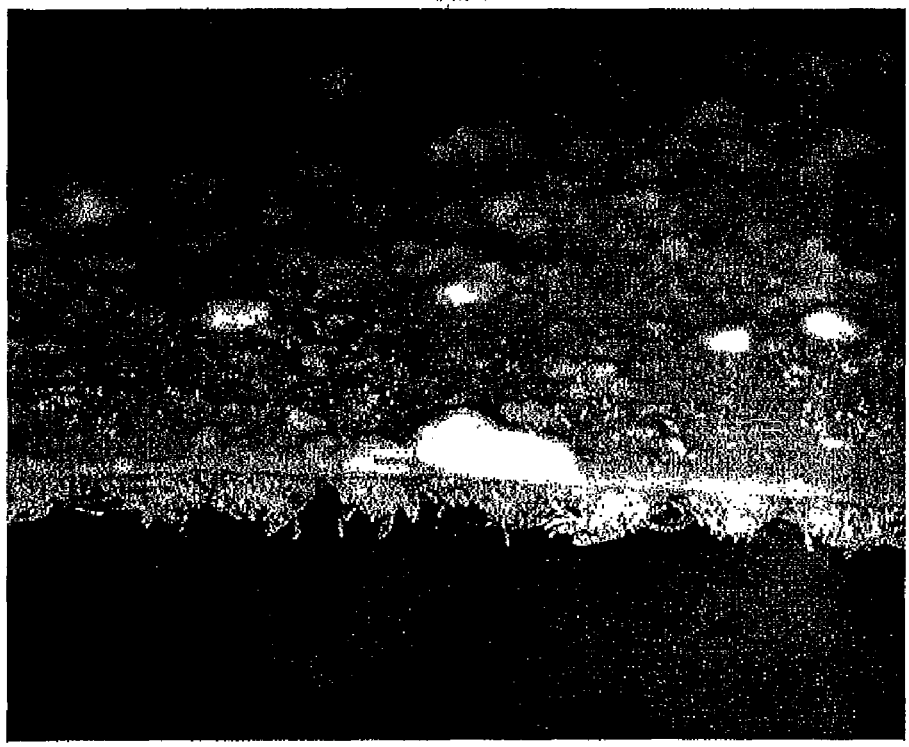

The glove of the invention is made of a resin or rubber, or made of a base cloth for a glove, a fiber liner, which is coated with a resin or rubber, on which, at least whose surface, an anti-slip layer containing pulverized fragments of a foamed melamine resin contained in a resin or rubber is formed. The whole glove may be made of the pulverized fragments of the foamed melamine resin without limiting the surface part; however, gloves produced by coating a fiber liner with a resin or rubber and then coating the surface thereof with a resin or rubber containing pulverized fragments of a foamed melamine resin are preferable embodiments. The whole glove may also be made of a resin or rubber, without using the liner. The pulverized fragments of the foamed melamine resin are obtained by pulverizing a foamed melamine resin, and the foamed melamine resin has a three-dimensional lattice structure. Consequently, the pulverized fragments of the foamed melamine resin obtained by pulverizing the foam have, as shown in FIG. 1, cut limbs extending three dimensionally, which obtained by cutting connection parts of the lattice parts. In other words, the foamed melamine resin has the three-dimensional lattice structure in which limbs extending three dimensionally are bonded to each others, and the limbs are cut at suitable parts to produce the pulverized fragments, each of the pulverized fragments obtained as above has cut connection part at its edge. The pulverized fragments may have connection parts which are not cut, or may not have connection parts, depending on the cut part.

The pulverized fragments of the foamed melamine resin obtained by pulverizing the foam are set to have the maximum linear length of about from 1 to 700 μm, more preferably from 3 to 500 μm further more preferably from 3 to 400 μm. The maximum linear length herein refers to the maximum length of a straight line between the pointed tip of the cut limb and any point. The length of the cut limb extending three dimensionally is preferably from 1 to 250 μm. The pulverized fragments of the foamed melamine resin are contained in the anti-slip layer, and the cut limbs mainly protrude from the surface of the anti-slip layer, and thus the anti-slipping effect is exhibited. The height of the protrusions which protrude from the surface of the anti-slip layer and formed by the pulverized fragments of the foamed melamine resin is preferably from 3 to 400 μm, more preferably from 3 to 200 μm, further more preferably from 15 to 200 μm. When the height is less than 3 μm, the anti-slipping effect is reduced, and when it is more than 400 μm, the protrusion parts of the pulverized fragments are easily scoured off during the use of the glove. The diameter of the cut limb is preferably from about 1 to 20 μm.

The amount of the pulverized fragments of the foamed melamine resin contained in the anti-slip layer is from 3 to 70 parts by weight, more preferably from 5 to 50 parts by weight, further more preferably form 5 to 20 parts by weight relative to 100 parts by weight of the resin or rubber. As the resin or rubber used in the anti-slip layer, polyurethane resins are particularly preferable, but NBR, chloroprene rubber (CR), isoprene rubber (IR), vinyl chloride resins, and other various resins and rubbers can be used. In this embodiment, the layer is one obtained by coating the polyurethane resin mixed with the above-mentioned pulverized fragments of the foamed melamine resin. The thickness of the anti-slip layer is set preferably to be from 5 to 30 μm.

As to the anti-slip layer, the resin or rubber to be coated including only the pulverized fragments of the foamed melamine resin may be used, and also the resin or rubber to be coated including a mixture of the pulverized fragments of the foamed melamine resin and other particles may be used. The particles to be mixed may have any shape such as spherical type, polyhedral type, hemispheric type, or bowl type. When these particles are mixed and they contact with an object, contact points having a convex shape similar to a plane are formed, whereby the anti-slipping property under non-wet conditions can be improved. Of these, organic particles made of a resin or rubber can give higher anti-slipping property, and NBR particles among them are preferable because they have well-balance between strength and flexibility as well as higher anti-slipping property. The NBR particles may be non-foamed particles which are obtained by pulverizing cured NBR rubber. The amount of the NBR particles contained is from 25 to 55 parts by weight, more preferably from 30 to 50 parts by weight relative to 100 parts by weight of the resin or rubber component.

When the mixture of the pulverized fragments of the foamed melamine resin and the NBR particles is contained in the resin or rubber, it is preferable that the height of the protrusions of the NBR particles, which protrude from the surface of the anti-slip layer, is from 30 to 1500 μm. Further, it is preferable that the average height of the protrusions of the NBR particles which protrude from the surface of the anti-slip layer is higher than that of the protrusions of the pulverized fragments of the foamed melamine resin which protrude from the surface of the anti-slip layer.

EXAMPLE

Next, a test in which anti-slipping effects toward glass are compared using tactile sensation will be described.

Examples 1 to 7

Each glove was produced as follows: First, a sewn liner made of nylon yarn was covered on a hand-former for processing, which was dipped in a material 1 listed below, and pulled up. Then, it was dipped in water having a temperature of 50° C. for 60 minutes, thereby replacing the water-soluble organic solvent by water to foam and solidify the polyurethane. After that, the hand-former was pulled up out of water and dried. Subsequently, the dried one was dipped in a material 2 listed below, pulled up, and dried. Further, the dried one was dipped in a material 3, pulled up and dried. After drying, the obtained glove was released from the hand-former.

(Material 1)

A mixture of a polyurethane resin ("CRISVON (registered trade mark) 7667" manufactured by Dainippon Ink and Chemicals, Inc.,) and DMF (dimethyl formamide) having a solid content of 10%.

(Material 2)

A dispersion of a polyurethane resin ("CRISVON (registered trade mark) 3354" manufactured by Dainippon Ink and Chemicals, Inc.,) in a mixed solvent of 1:1 IPA (isopropyl alcohol) and xylene, having a solid content of 10%.

(Material 3)

A dispersion of a polyurethane resin ("CRISVON (registered trade mark) 3354" manufactured by Dainippon Ink and Chemicals, Inc.,) and pulverized fragments of a foamed melamine resin in a mixed solvent of IPA and xylene at ratio of 1:1, having a solid content of 11%. The pulverized fragments of the foamed melamine resin were obtained by pulverizing the melamine foam.

In the gloves of Examples 1 to 7, the amounts of the pulverized fragments of the foamed melamine resin contained in the material 3, which were finally coated for providing the anti-slip layer, are shown in Table 1.

Examples 8 to 12

After the step using the material 1 was performed, the obtained one was dipped in the material 2, pulled up and dried in accordance with the production method of Examples. As the material 3, a dispersion of non-foamed particles obtained by pulverizing general cured NBR rubber and pulverized fragments of a foamed melamine resin in the mixed solvent of IPA and xylene at ratio of 1:1 was coated to finally form an anti-slip layer. The amounts of the NBR non-foamed pulverized particles and the pulverized fragments of the foamed melamine resin contained in Examples 8 to 12 are shown in Table 1.

Comparative Example 1

After the step using the material 1 was performed, the obtained one was dipped in the material 2, pulled up and dried in accordance with the production method of Example 1. The obtained one was not dipped in the material 3, and was released from the hand-former to give a glove. That is, the glove in Comparative Example 1 was not subjected to a final coating treatment to form an anti-slip layer, and the amount of the pulverized fragments of the foamed melamine resin contained was 0 parts by weight.

Comparative Example 2

After the step using the material 1 was performed, the obtained one was dipped in the material 2, pulled up and dried in accordance with the production method of Examples. As the material 3, a dispersion of 40 parts by weight of particles obtained by pulverizing a general cured NBR rubber in a mixed solvent of IPA and xylene at ratio of 1:1 was coated to finally form an anti-slip layer.

Comparative Examples 3 and 4

As the material 3, a dispersion of a polyurethane resin ("CRISVON (registered trade mark) 3354" manufactured by Dainippon Ink and Chemicals, Inc.,) or pulverized particles of polyurethane resin foam in a mixed solvent of 1:1 IPA and xylene was coated to finally form anti-slip layers. The same procedure as in Examples 1 to 8 was repeated except that the different materials 3 were used. The amount of the pulverized particles of the polyurethane foam contained were, as shown in Table 1, 5 parts by weight for Comparative Example 3 and 10 parts by weight for Comparative Example 4 relative to 100 parts by weight of the polyurethane resin.

Comparative Example 5

After the step using the material 1 was performed, the obtained one was dipped in the material 2, pulled up and dried in accordance with the production method of Examples. As the material 3, a dispersion of 10 parts by weight of pulverized fragments of PVA foam in a mixed solvent of IPA and xylene at ratio of 1:1 was coated to finally form an anti-slip layer.

Using the gloves produced in Examples 1 to 12, and Comparative Examples 1 to 5, the anti-slipping effects toward glass under non-wet, wet, detergent-wet and oil-wet conditions were evaluated by 10 persons. The criteria are: 9 shows a glove does not slip; 8 shows a glove hardly slips; 7 shows it is difficult to slip; 6 shows a glove sometimes slips but it can be said it is difficult to slip; 5 shows a glove sometimes slips; 4 shows a glove slightly slips but it is possible to use it; 3 shows it is possible to use a glove, though it slips; 2 shows a glove slips; and 1 shows a glove slips well. The results are shown in Table 1. As for the anti-slipping effect on glass under non-wet conditions, in order to study the relationship in the height of the protrusions between the pulverized fragments of the foamed melamine resin and the pulverized particles of NBR which was not foamed, the heights of the protrusions were measured in only Examples 1, 3, and 8 to 12. The results are shown in Table 1.

As shown in Table 1, in Examples 1 to 12, the anti-slipping effects toward, in particular, oil-wet glass were exhibited, and in particular, the larger the amount of the pulverized fragments of the foamed melamine resin, the better the anti-slipping effects. Table 1 shows that, in order to obtain the better anti-slipping effect toward oil wetness, the amount of the pulverized fragments of the foamed melamine resin contained is preferably 3 parts by weight or more.

As for the detergent, the anti-slipping effect was generated in Examples 1 to 12, and when the amount of the pulverized fragments of the foamed melamine resin contained was from 5 to 20 parts by weight, particularly good anti-slipping effect was exhibited.

As for the moisture-wet glass, the anti-slipping effect was generally generated in Examples 1 to 8, and when the amount of the pulverized fragments of the foamed melamine resin contained was from 3 to 20 parts by weight, the particularly good anti-slipping effect was exhibited.

When the amount of the pulverized fragments of the foamed melamine resin contained was 70 parts by weight or more (Example 6), the appearance was different from the design quality, the obtained hardness was higher than that of the design quality, and the detachment of the particles could be found.

Under the non-wet conditions, the gloves in Examples 1 and 3 could be used, but it was evaluated that they slipped. On the other hand, in Examples 8 and 9, in which though the amount of the pulverized fragments of the foamed melamine resin contained and the height of the protrusions were the same as those in Examples 1 and 3, the NBR particles were blended, were evaluated that the it was difficult to slip even under the non-wet conditions. These results show that blending NBR particles can keep anti-slipping effects to moisture, detergents, and oil, and exhibit an excellent anti-slipping effect even to the non-wet conditions.

The amount of the pulverized fragments of the foamed melamine resin contained in Example 8 was smaller than that in Example 9, and accordingly the anti-slipping effect toward the oils in Example 8 was relatively inferior to that in Example 9. Even if the amounts contained were the same, however, as shown by the results in Examples 10 and 11, when the height of the protrusions of the pulverized fragments of the foamed melamine resin were made higher, the anti-slipping effect toward oil was extremely improved. As apparent from the results in Examples 8, 10 to 12, when the height of the protrusions of the NBR particles was higher than that of the protrusions of the pulverized fragments of the foamed melamine resin, the anti-slipping effect under non-wet condition was more excellent.

Although the embodiments of the present invention have been described, it should be appreciated that the invention is not limited to these Examples, and it can be carried out in various embodiments without departing from the gist of the invention.

TABLE 1

| | Pulverized fragments of foamed melamine resin (Amount) | Evaluation of anti-slipping | | | | Height from surface to protrusion (μm) | |
|---|---|---|---|---|---|---|---|
| | | Non-wet | Wetness | Detergent | Oil | Pulverized fragments of foamed melamine resin | Pulverized particles of NBR non-foam |
| Example 1 | Pulverized fragments of foamed melamine resin (10 parts by weight) | 3 | 7 | 7 | 7 | 15-200 | — |
| Example 2 | Pulverized fragments of foamed melamine resin (3 parts by weight) | 3 | 7 | 4 | 4 | | |
| Example 3 | Pulverized fragments of foamed melamine resin (5 parts by weight) | 3 | 7 | 7 | 4 | 15-200 | — |
| Example 4 | Pulverized fragments of foamed melamine resin (20 parts by weight) | 3 | 4 | 7 | 7 | | |
| Example 5 | Pulverized fragments of foamed melamine resin (50 parts by weight) | 3 | 4 | 4 | 9 | | |
| Example 6 | Pulverized fragments of foamed melamine resin (70 parts by weight) | 3 | 4 | 4 | 7 | | |
| Example 7 | Pulverized fragments of foamed melamine resin (1 parts by weight) | 5 | 4 | 4 | 3 | | |
| Example 8 | Pulverized particles of NBR non-foam (40 parts by weight) + Pulverized fragments of foamed melamine resin (5 parts by weight) | 7 | 7 | 7 | 4 | 15-200 | 30-450 |
| Example 9 | Pulverized particles of NBR non-foam (40 parts by weight) + Pulverized fragments of foamed melamine resin (10 parts by weight) | 7 | 7 | 7 | 7 | 15-200 | 30-450 |
| Example 10 | Pulverized particles of NBR non-foam (40 parts by weight) + Pulverized fragments of foamed melamine resin (5 parts by weight) | 6 | 7 | 7 | 7 | 120-400 | 30-450 |
| Example 11 | Pulverized particles of NBR non-foam (40 parts by weight) + Pulverized fragments of foamed melamine resin (5 parts by weight) | 5 | 7 | 7 | 7 | 120-400 | 30-100 |
| Example 12 | Pulverized particles of NBR non-foam (40 parts by weight) + Pulverized fragments of foamed melamine resin (5 parts by weight) | 8 | 6 | 6 | 3 | 15-200 | 200-1500 |
| Comparative Example 1 | None | 3 | 2 | 2 | 1 | | |
| Comparative Example 2 | Pulverized particles of NBR non-foam (40 parts by weight) | 8 | 2 | 2 | 2 | | |
| Comparative Example 3 | Pulverized particles of polyurethane foam (5 parts by weight) | 5 | 2 | 2 | 2 | | |
| Comparative Example 4 | Pulverized particles of polyurethane foam (10 parts by weight) | 4 | 2 | 2 | 2 | | |
| Comparative Example 5 | Pulverized fragments of PVA foam (10 parts by weight) | 2 | 2 | 2 | 2 | | |

What is claimed is:

1. A glove made of a resin or rubber, or a base cloth for a glove coated with a resin or rubber, wherein the glove has an anti-slip layer at least on a part of the surface of the palm area, and the anti-slip layer contains pulverized fragments of a foamed melamine resin or a mixture of pulverized fragments of a foamed melamine resin and NBR particles.

2. The glove of claim 1, wherein the average height of the protrusions of the NBR particles which protrude from the surface of the anti-slip layer is higher than the average height of the protrusions of the pulverized fragments of the foamed melamine resin which protrude from the surface of the anti-slip layer, when the mixture of the pulverized fragments of the foamed melamine resin and the NBR particles is contained in the resin or rubber.

3. The glove of claim 1, wherein the anti-slip layer is formed by coating a polyurethane resin having mixed therein the pulverized fragments of the foamed melamine resin or the mixture of the pulverized fragments of the foamed melamine resin and the NBR particles.

4. The glove of claim 1, wherein the anti-slip layer has a thickness of 5 to 30 μm.

5. The glove of claim 1, wherein the anti-slip layer comprises 3 to 70 parts by weight of the pulverized fragments of the foamed melamine resin relative to 100 parts by weight of the resin or rubber component.

6. The glove of claim 1, wherein the pulverized fragments of the foamed melamine resin have a three-dimensional lattice structure, and cut limbs extending three dimensionally.

7. The glove of claim 6, wherein the anti-slip layer comprises 3 to 70 parts by weight of the pulverized fragments of the foamed melamine resin relative to 100 parts by weight of the resin or rubber component.

8. The glove of claim 6, wherein the average height of the protrusions of the NBR particles which protrude from the surface of the anti-slip layer is higher than the average height of the protrusions of the pulverized fragments of the foamed melamine resin which protrude from the surface of the anti-slip layer, when the mixture of the pulverized fragments of the foamed melamine resin and the NBR particles is contained in the resin or rubber.

9. The glove of claim 6, wherein the height of protrusions of the pulverized fragments of the foamed melamine resin which protrude from the surface of the anti-slip layer is from 3 to 400 μm.

10. The glove of claim 9, wherein the anti-slip layer comprises 3 to 70 parts by weight of the pulverized fragments of the foamed melamine resin relative to 100 parts by weight of the resin or rubber component.

11. The glove of claim 10, wherein the average height of the protrusions of the NBR particles which protrude from the surface of the anti-slip layer is higher than the average height of the protrusions of the pulverized fragments of the foamed melamine resin which protrude from the surface of the anti-slip layer, when the mixture of the pulverized fragments of the foamed melamine resin and the NBR particles is contained in the resin or rubber.

12. The glove of claim 9, wherein the average height of the protrusions of the NBR particles which protrude from the surface of the anti-slip layer is higher than the average height of the protrusions of the pulverized fragments of the foamed melamine resin which protrude from the surface of the anti-slip layer, when the mixture of the pulverized fragments of the foamed melamine resin and the NBR particles is contained in the resin or rubber.

13. The glove of claim 1, wherein the maximum linear length of the pulverized fragments of the foamed melamine resin is from 3 to 400 μm.

14. The glove of claim 13, wherein the anti-slip layer comprises 3 to 70 parts by weight of the pulverized fragments of the foamed melamine resin relative to 100 parts by weight of the resin or rubber component.

15. The glove of claim 14, wherein the average height of the protrusions of the NBR particles which protrude from the surface of the anti-slip layer is higher than the average height of the protrusions of the pulverized fragments of the foamed melamine resin which protrude from the surface of the anti-slip layer, when the mixture of the pulverized fragments of the foamed melamine resin and the NBR particles is contained in the resin or rubber.

16. The glove of claim 13, wherein the average height of the protrusions of the NBR particles which protrude from the surface of the anti-slip layer is higher than the average height of the protrusions of the pulverized fragments of the foamed melamine resin which protrude from the surface of the anti-slip layer, when the mixture of the pulverized fragments of the foamed melamine resin and the NBR particles is contained in the resin or rubber.

17. The glove of claim 1, wherein the height of protrusions of the NBR particles which protrude from the surface of the anti-slip layer is from 30 to 1500 μm, when the mixture of the pulverized fragments of the foamed melamine resin and the NBR particles is contained in the resin or rubber.

18. The glove of claim 17, wherein the average height of the protrusions of the NBR particles which protrude from the surface of the anti-slip layer is higher than the average height of the protrusions of the pulverized fragments of the foamed melamine resin which protrude from the surface of the anti-slip layer, when the mixture of the pulverized fragments of the foamed melamine resin and the NBR particles is contained in the resin or rubber.

* * * * *